US009671148B2

(12) United States Patent
Monroe, Sr.

(10) Patent No.: US 9,671,148 B2
(45) Date of Patent: Jun. 6, 2017

(54) APPARATUS AND METHOD FOR COOLING A CONTAINERIZED FLUID

(71) Applicant: Ronald J. Monroe, Sr., Milan, GA (US)

(72) Inventor: Ronald J. Monroe, Sr., Milan, GA (US)

(73) Assignee: RRORO'S INNOVATIONS, LLC, Milan, GA (US)

( * ) Notice: Subject to any disclaimer, the term of this patent is extended or adjusted under 35 U.S.C. 154(b) by 379 days.

(21) Appl. No.: 14/462,552

(22) Filed: Aug. 18, 2014

(65) Prior Publication Data

US 2015/0047387 A1 Feb. 19, 2015

Related U.S. Application Data

(60) Provisional application No. 61/866,562, filed on Aug. 16, 2013.

(51) Int. Cl.
*F25D 17/02* (2006.01)
*F25D 3/10* (2006.01)
(Continued)

(52) U.S. Cl.
CPC ..... *F25D 3/107* (2013.01); *B67D 1/0859* (2013.01); *F25B 39/028* (2013.01);
(Continued)

(58) Field of Classification Search
CPC ..... F25D 3/005; F25D 3/10; F25D 31/002; F25D 31/003; F25D 31/007;
(Continued)

(56) References Cited

U.S. PATENT DOCUMENTS 1,468,876 A * 9/1923 Von Codelli ..... F25D 3/107 62/440
2,182,116 A 12/1939 Copeman
(Continued)

FOREIGN PATENT DOCUMENTS

EP 1 067 088 A1 1/2001
EP 1 688 686 A2 8/2006

*Primary Examiner* — Ryan J Walters
*Assistant Examiner* — Mark L Greene
(74) *Attorney, Agent, or Firm* — Michael Drew

(57) ABSTRACT

An apparatus for cooling a containerized fluid apparatus has a refrigerant-delivery assembly axially depending from a handle assembly. The handle assembly forms a receptacle for receiving a canister of refrigerant such as pressurized liquid carbon dioxide ($CO_2$). The refrigerant-delivery assembly comprises a supply tube through which refrigerant is fed from the canister in the handle assembly to a refrigerant-containment compartment enclosing an exit port of the supply tube and entry ports of one or more expansion tubes. The refrigerant-containment compartment places the supply tube in fluid-flow communication with the expansion tubes. The expansion tubes are rotatable about the axis of the supply tube. The expansion tubes are made to rotate by either a nozzle-turbine feature or a motor-and-gear subassembly. As refrigerant expands in the expansion tubes it takes on heat in accordance with thermodynamic properties thereby cooling the containerized fluid.

9 Claims, 1 Drawing Sheet

(51) Int. Cl.
*F25D 31/00* (2006.01)
*F25B 39/02* (2006.01)
*B67D 1/08* (2006.01)

(52) U.S. Cl.
CPC ..... *F25D 31/003* (2013.01); *F25D 31/006* (2013.01); *F25D 2400/28* (2013.01)

(58) Field of Classification Search
CPC ..... F25D 31/008; F25D 2303/0841; F25D 2303/0844; F25D 2331/803; F25D 2331/805; F25D 2331/808; F25D 2400/28; F25D 3/107; F25B 9/02; F25B 9/04; F25B 9/06; F25B 9/065; F25B 19/005; F28F 5/00; F28F 5/02; F28D 11/00; F28D 11/02; F28D 11/04; B67D 1/0859
USPC ..... 165/86
See application file for complete search history.

(56) References Cited

U.S. PATENT DOCUMENTS

| | | | | | |
|---|---|---|---|---|---|
| 2,752,763 | A | | 7/1956 | Shepard | |
| 2,956,418 | A | | 10/1960 | McCann | |
| 3,077,085 | A | * | 2/1963 | Johnston | F25D 3/107 62/293 |
| 5,115,940 | A | * | 5/1992 | Friedman | F25D 3/107 220/737 |
| 2005/0056028 | A1 | * | 3/2005 | Boukas | F25B 19/00 62/60 |
| 2009/0255272 | A1 | * | 10/2009 | Tibell | F25B 9/04 62/5 |

* cited by examiner

APPARATUS AND METHOD FOR COOLING A CONTAINERIZED FLUID

CROSS-REFERENCE TO RELATED APPLICATIONS

This application claims priority from U.S. provisional patent application No. 61/866562, filed Aug. 16, 2013, the entirety of which is hereby incorporated by reference.

STATEMENT REGARDING FEDERALLY SPONSORED RESEARCH OR DEVELOPMENT

Not applicable.

TECHNICAL FIELD

This invention relates to a portable refrigeration apparatus and method, and more particularly, the invention relates to a portable apparatus and method for quickly cooling the fluid contents of a container.

BACKGROUND OF THE INVENTION

It is often desirable to quickly cool a container of liquid for human consumption. Typical containers include a can, bottle, glass, jug, keg or the like that holds a beverage. It may be particularly desirable to be able to cool such containerized liquid rapidly and individually for convenience. Further, it may be desirable to cool such containerized liquid when cooling by means of ice or insertion of the container into a standard refrigeration unit is not readily available or practical. Thus it would be useful to have a portable apparatus for cooling an individual container of liquid.

SUMMARY OF THE INVENTION

The invention is an apparatus and method for cooling the fluid contents of a container. The apparatus of the invention is capable of being hand-held and is immersible in a container of fluid to be cooled. The apparatus comprises a refrigerant-delivery assembly axially depending from a handle assembly. The handle assembly forms a receptacle for receiving a canister of refrigerant such as pressurized liquid carbon dioxide ($CO_2$). The refrigerant-delivery assembly comprises a supply tube through which refrigerant is fed from the canister in the handle assembly to a refrigerant-containment compartment enclosing an exit port of the supply tube and entry ports of one or more expansion tubes. The refrigerant-containment compartment places the supply tube in fluid-flow communication with the expansion tubes. The expansion tubes are rotatable about the axis of the supply tube. As refrigerant under pressure reaches the expansion tubes it expands and takes on heat in accordance with thermodynamic properties thereby cooling the containerized fluid. Rotation of the expansion tubes enhances heat transfer (cooling). The expansion tubes are made to rotate by either a nozzle-turbine feature formed by the exit port of the supply tube and the inlet ports of the expansion tubes, or a motor-and-gear subassembly.

DETAILED DESCRIPTION

Figures 1, 2, 3, 4:
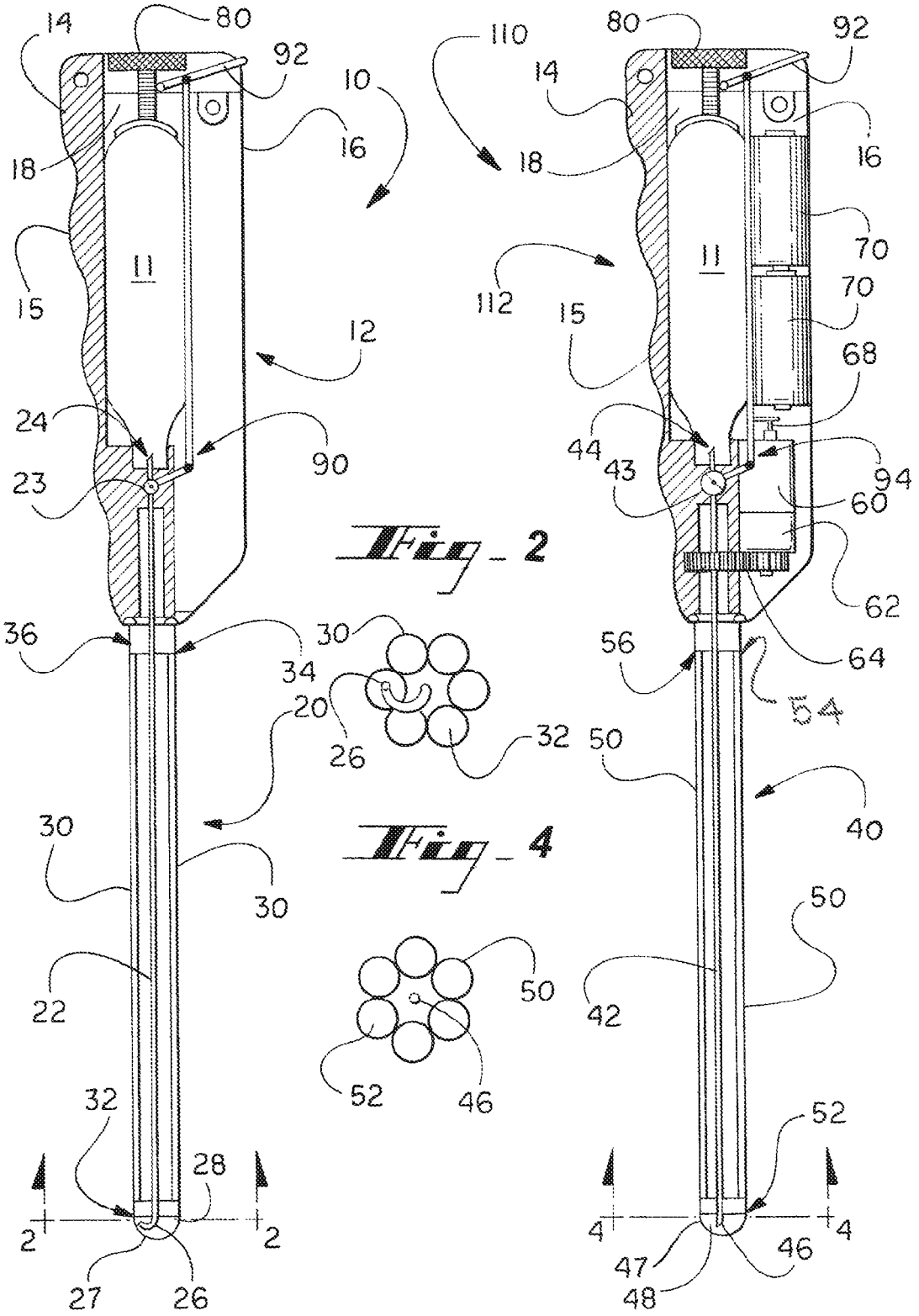
FIG. 1 is a schematic illustration of an embodiment of an apparatus for cooling a containerized fluid in accordance with the teachings of the invention.
FIG. 2 is a schematic illustration of a distal end of the refrigerant-delivery assembly of the apparatus of FIG. 1 taken along line 2-2 of FIG. 1.
FIG. 3 is a schematic illustration of a second embodiment of an apparatus for cooling a containerized fluid in accordance with the teachings of the invention.
FIG. 4 is a schematic illustration of a distal end of the refrigerant-delivery assembly of the apparatus of FIG. 3 taken along line 4-4 of FIG. 3.

Embodiments of the present invention are described herein. The disclosed embodiments are merely exemplary of the invention that may be embodied in various and alternative forms, and combinations thereof. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods have not been described in detail in order to avoid obscuring the present invention. Therefore, at least some specific structural and functional details disclosed herein are not to be interpreted as limiting, but merely as a basis for the claims and as a representative basis for teaching one skilled in the art to variously employ the present invention.

As an overview, the invention teaches an apparatus and method for cooling a containerized fluid. In an aspect of the invention, the fluid is a liquid beverage for individualized human consumption; however, the teachings of the invention are also applicable to liquids other than beverages and to fluids other than liquids. The apparatus of the invention delivers an expandable refrigerant such as pressurized $CO_2$ to an arrangement of at least one immersible tube through which heat transfer with the fluid to be cooled is achieved.

Referring first to FIG. 1, therein is schematically illustrated an embodiment of an apparatus 10 for cooling a containerized fluid in which a refrigerant-delivery assembly 20 depends axially from a handle assembly 12. The handle assembly 12 has grasping elements 14, 16 for holding the apparatus 10 and immersing the lower portion into a container of fluid to be cooled. A contoured outer region 15 of a grasping element 14 facilitates grasping by an individual using the apparatus 10. The grasping elements form a space in the form of a slot, which may also be considered a receptacle, 18 for receiving and retaining a canister 11 of refrigerant. For example, a canister of $CO_2$ under pressure is taught by the invention as suitable. A pressurized canister of liquid carbon dioxide ($CO_2$) is often referred to as a cartridge.

A refrigerant-delivery assembly 20 is attached to and extends axially from the handle assembly 12. A substantially elongated refrigerant supply tube 22 is centrally disposed in the refrigerant-delivery assembly 20 thereby serving as an axis. At least one substantially elongated expansion tube 30 is disposed in substantially parallel (more parallel than not) alignment with the supply tube 22. The expansion tubes 30 are rotatable about the axis of the supply tube 22. One end of each expansion tube 30 is an inlet port 32 that is disposed in close proximity to the exit port 26 of the centrally-disposed supply tube 22. Refrigerant exits the supply tube 22 and enters the expansion tubes 30 in a refrigerant-containment compartment 28. The refrigerant-containment compartment 28 is formed by an end-cap 27 that seals the distal end of the refrigerant-delivery assembly 20. Referring momentarily to FIG. 2, the arrangement of exit port 26 of the supply tube 22 and the inlet ports 32 of the expansion tubes 30 is more easily seen. Referring now also to FIG. 1, the exit port 26 of the supply tube 22 is tapered and curved so as to be angularly directed toward the inlet ports 32 of the expansion tubes. This arrangement within the refrigerant-containment compartment 28 provides a mechanism for causing the set of expansion tubes 30 to rotate about the axis of the supply tube 22.

In operation of the apparatus, once the canister is punctured refrigerant under pressure escapes from the canister 11 and travels through the supply tube 22 into the refrigerant-containment compartment 28. The refrigerant seeks the path of least resistance, that is, lower pressure, and thus enters the expansion tubes through the inlet ports 32. The refrigerant attains maximum expansion in the expansion tubes 30 and thus takes on heat in accordance with thermodynamic principles thereby cooling the medium (fluid/liquid) adjacent the expansion tubes 30. The tapered, curved exit port 26 of the supply tube forms a nozzle from which refrigerant under pressure impinges the inlet ports 32 of the expansion tubes 30 thereby creating a turbine mechanism that rotates the expansion tubes 30 about the axis of the supply tube 22.

Each expansion tube 30 has a second end terminating in an exhaust port 34. A solid-precipitate collector 36 is disposed proximate the exhaust port 34 to substantially inhibit the release of solid precipitate through the exhaust port 34. The collector 36 is also a gaseous filter that allows air in the apparatus to vent from the exhaust port 34 when $CO_2$ is first projected through the supply tube 22 and expansion tubes 30. The collector/filter 36 comprises material which is substantially gas-permeable, such as a gas-permeable membrane.

The canister/cartridge 11 is typically sealed in a closed condition. The gaseous contents of the canister 11 can be released by puncturing an end of the canister 11. The tapered entry port 24 of the supply tube 22 is disposed for puncturing the end of the canister 11 and thereby releasing its contents into the supply tube 22. A screw mechanism disposed with respect to the handle assembly 10 helps form a puncture structure in which a screw is turned to advance the $CO_2$ canister 11 against the needled entry port 24 of the supply tube 22 until the end of the canister 11 is punctured. A knobbed screw element 80 forms a part of the mechanism for urging the canister 11 into contact with the entry port 24 of the supply tube. When the screw 80 is turned it advances axially in the handle assembly 12 urging the canister 11 onto the tapered, needle-like, entry port 24 of the supply tube. Once the canister 11 is punctured, refrigerant is permitted to escape the canister and flow but for the valve 23 in the supply tube 22. The valve 23 is selectively made to open and close through an actuator 90 formed by a plunger structure that has a trigger 92 that is disposed for engagement by a finger or thumb (digit) of a user.

After the cartridge is punctured, the release of $CO_2$ is initiated when the valve mechanism 23 is opened through engagement of the trigger 92. When $CO_2$ flows, the expansion tubes 30 are placed in rotational motion about the longitudinal axis of the supply tube 22 by the turbine mechanism. $CO_2$ travels through each expansion tube 30 where it expands taking on heat energy. In use, the apparatus 20 is placed in a container of fluid such as a liquid beverage whereby the lengths of the expansion tubes 30 are substantially immersed in the fluid to be cooled. The trigger 92 is engaged to release $CO_2$. The release of $CO_2$ causes rotation of the expansion tubes 30 and causes the expansion tubes 30 to fill with $CO_2$ thereby facilitating transfer of heat energy from the liquid in which the apparatus 20 is partially submersed. The containerized fluid is thereby cooled.

Referring now to FIG. 2, therein is schematically illustrated a motorized apparatus 110 comprising many of the same elements as the non-motorized apparatus 10 of FIG. 1. A refrigerant-delivery assembly 40 depends axially from a handle assembly 112. The handle assembly 112 has grasping elements 14, 16 for holding the apparatus 110 and immersing the lower portion into a container of fluid to be cooled. A contoured outer region 15 of a grasping element 14 facilitates grasping by an individual using the apparatus 110. The grasping elements form a space in the form of a slot, which may also be considered a receptacle, 18 for receiving and retaining a canister 11 of refrigerant. For example, a canister of $CO_2$ under pressure is taught by the invention as suitable. A pressurized canister of liquid carbon dioxide ($CO_2$) is often referred to as a cartridge. Batteries 70 provide energy for the motor 60.

A refrigerant-delivery assembly 40 is attached to and extends axially from the handle assembly 112. A substantially elongated refrigerant supply tube 42 is centrally disposed in the refrigerant-delivery assembly 40 thereby serving as an axis. At least one substantially elongated expansion tube 50 is disposed in substantially parallel (more parallel than not) alignment with the supply tube 42. The expansion tubes 50 are rotatable about the axis of the supply tube 42. One end of each expansion tube 50 is an inlet port 52 that is disposed in close proximity to the exit port 46 of the centrally-disposed supply tube 42. Refrigerant exits the supply tube 42 and enters the expansion tubes 50 in a refrigerant-containment compartment 48. The refrigerant-containment compartment 48 is formed by an end-cap 47 that seals the distal end of the refrigerant-delivery assembly 40. Referring momentarily to FIG. 4, the arrangement of exit port 46 of the supply tube 42 and the inlet ports 52 of the expansion tubes 50 is more easily seen.

In operation of the apparatus, once the canister is punctured refrigerant under pressure escapes from the canister 11 and travels through the supply tube 42 into the refrigerant-containment compartment 48. The refrigerant seeks the path of least resistance, that is, lower pressure, and thus enters the expansion tubes through the inlet ports 52. The refrigerant attains maximum expansion in the expansion tubes 50 and thus takes on heat in accordance with thermodynamic principles thereby cooling the medium (fluid/liquid) adjacent the expansion tubes 50.

The canister/cartridge 11 is typically sealed in a closed condition. The gaseous contents of the canister 11 can be released by puncturing an end of the canister 11. The tapered entry port 44 of the supply tube 42 is disposed for puncturing the end of the canister 11 and thereby releasing its contents into the supply tube 42. A screw mechanism disposed with respect to the handle assembly 110 helps form a puncture structure in which a screw element 80 is turned to advance the $CO_2$ canister 11 against the needled entry port 44 of the supply tube 42 until the end of the canister 11 is punctured. A knobbed screw element 80 forms a part of a mechanism for urging the canister 11 into contact with the entry port 44 of the supply tube. When the screw 80 is turned it advances axially in the handle assembly 112 urging the canister 11 onto the tapered, needle-like, entry port 44 of the supply tube 42. Once the canister 11 is punctured, refrigerant is permitted to escape the canister and flow but for the valve 43 in the supply tube 42. The valve 43 is selectively made to open and close through an actuator 94 formed by a plunger structure that has a trigger 92 that is disposed for engagement by a finger or thumb (digit) of a user.

When the $CO_2$ canister/cartridge is punctured, pressurized $CO_2$ is able to be released to enter the entry port 44 at the end of the needle and to exit the supply tube 42 through the exit port 46. After the cartridge 11 is punctured, the release of $CO_2$ is initiated when the valve 43 is opened through engagement of the trigger 92. In the embodiment of FIG. 2, the trigger 92 not only opens the valve 43 but also closes the switch 68 that energizes a motor 60 which in turn drives a gear arrangement of a gear box 62 and drive gears 64 that rotates the expansion tubes 50 about the supply tube 42. When $CO_2$ flows, $CO_2$ travels through each expansion tube 50 where upon expansion it takes on heat energy.

In operation and use of the apparatus, the rotation of the expansion tubes 30, 50 creates a stirring, or swirling effect, that enhances heat transference (that is, cooling) between the fluid in which the lower end of the apparatus 10, 110 is immersed and the expansion tubes 30, 50. In the embodiments illustrated in FIGS. 1 2, 3 and 4 herein, six (6) expansion tubes 30, 50 are employed. However, as few as a single expansion tube 30, 50 can be used but greater heat transference (that is, cooling) is achieved by the use of multiple tubes.

Method of Use

In initial use of the apparatus 10, 110 the $CO_2$ in the cartridge is in a liquid phase under high pressure. When the valve 13 is opened, $CO_2$ is permitted to flow into and through the supply tube 22, 42, the refrigerant containment compartment 28, 48 and the expansion tubes 30, 50. As $CO_2$ fills the refrigerant containment compartment 28, 48, liquid $CO_2$ that has not already vaporized is vaporized and resulting gaseous $CO_2$ flows from the compartment 28, 48 and into and through the expansion tubes 30, 50 to the vent at the exhaust ports 34, 54. Because the flowing $CO_2$ is no longer under the high pressure of the sealed cartridge 11 it converts from the liquid phase to a gaseous phase. Because of the chemical characteristics of $CO_2$, upon expansion from liquid to gaseous phase the temperature of the $CO_2$ decreases causing it to act as a refrigerant. Heat transfer occurs primarily through the walls of the expansion tubes 30, 50 between the fluid in a container in which the apparatus 20, 40 is partially submersed and the cooler $CO_2$ gas thereby cooling the containerized fluid. The rapid release of pressure causes some solid particles to crystalize. These crystalized particles are in the form of flakes. Any air that is initially contained in the supply tube 22, 42, containment compartment 28, 48 and expansion tubes 30, 50 is vented through the exhaust ports 34, 54 of the expansion tubes 30, 50 and the collector/filter 36, 56. When solid crystals accumulate in the collector 36, 56 the exhaust ports 34, 54 effectively become closed off. The closed system then has cool $CO_2$ gas serving as a heat sink for fluid in which the apparatus is partially submersed.

Rotation of the expansion tubes 30, 50 through either the turbine effect of the embodiment of FIG. 1 or the motor 60 of the embodiment of FIG. 3 provides a swirling effect that enhances heat transfer (that is, cooling of the containerized fluid).

Many variations and modifications may be made to the above-described embodiments without departing from the scope of the claims. For example, although six (6) expansion tubes 30, 50 are shown in the embodiment illustrated and discussed above, the teachings of the invention encompass fewer or more than six (6) expansion tubes. As another example, of the expansive teachings of the invention, other suitable types of refrigerant include those types of refrigerants that are not harmful when released in the atmosphere or if consumed by humans, and, further, which may be provided in a pressurized canister. All such modifications, combinations, and variations are included herein by the scope of this disclosure and the following claims.

The invention claimed is:

1. An apparatus for cooling a containerized fluid comprising:

a handle assembly and a refrigerant-delivery assembly depending axially from said handle assembly;

said handle assembly comprising grasping elements adapted for being grasped by a hand of an individual and a receptacle adapted for receiving and retaining a canister of refrigerant;

said refrigerant-delivery assembly comprising a supply tube extending axially from said handle assembly having a first end terminating in an entry port disposed adjacent said handle assembly adapted for receiving refrigerant from said canister of refrigerant and a second end terminating in an exit port;

a valve disposed within said supply tube proximate said entry port thereof for regulating flow through said supply tube;

at least one expansion tube parallel to an axis of said supply tube, rotatable about said axis of said supply tube, having a first end proximate said exit port of said supply tube terminating in an inlet port and a second end distal said first end terminating in an exhaust port;

a refrigerant-containment compartment enclosing said exit port of said supply tube and said inlet ports of said expansion tubes in fluid-flow communication with one another; and a rotation mechanism adapted for causing said at least one expansion tube to rotate about said axis of said supply tube.

2. The apparatus of claim 1, wherein said rotation mechanism comprises said exit port terminating in a curved end angularly directed toward said inlet ports of said expansion tubes.

3. The apparatus of claim 1, further comprising an actuator adapted for selectively opening and closing said valve comprising a plunger mechanism adapted for being engaged by a digit of an individual so as to place said valve in an open condition when said plunger is engaged.

4. The apparatus of claim 1, wherein said rotation mechanism comprises a motor.

5. The apparatus of claim 4, further comprising a switch for selectively energizing said motor.

6. The apparatus of claim 5, further comprising an actuator adapted for selectively opening and closing said valve comprising a plunger mechanism adapted for being engaged by a digit of an individual so as to place said valve in an open condition and to activate said switch when said plunger is engaged.

7. The apparatus of claim 1, said refrigerant-delivery assembly further comprising a gas-permeable filter disposed adjacent each said exhaust port of said at least one expansion tube adapted for capturing ice particles forming at said exhaust ports.

8. The apparatus of claim 1, wherein said entry port of said supply tube terminates in a tapered opening adapted for puncturing a canister of refrigerant.

9. The apparatus of claim 8, further comprising an advancement mechanism for advancing a canister of refrigerant upon said tapered opening of said entry port of said supply tube.

* * * * *